United States Patent [19]

Bulso, Jr. et al.

[11] Patent Number: 4,732,031

[45] Date of Patent: Mar. 22, 1988

[54] METHOD OF FORMING A DEEP-DRAWN AND IRONED CONTAINER

[75] Inventors: Joseph D. Bulso, Jr., Canton; James A. McClung, North Canton, both of Ohio

[73] Assignee: Redicon Corporation, Canton, Ohio

[21] Appl. No.: 40,247

[22] Filed: Apr. 20, 1987

[51] Int. Cl.[4] ..... B21D 22/21; B21D 22/24

[52] U.S. Cl. ..... 72/363; 72/348; 72/350; 72/467

[58] Field of Search ..... 72/76, 329, 336, 347, 72/348, 349, 350, 467, 469, 363

[56] References Cited

U.S. PATENT DOCUMENTS

| | | | |
|---|---|---|---|
| 1,649,841 | 11/1927 | May . | |
| 2,531,663 | 11/1950 | Biginelli et al. | 72/336 |
| 2,761,406 | 9/1956 | Schnell | 72/359 |
| 3,402,591 | 9/1968 | Maeder | 72/345 |
| 3,945,231 | 3/1976 | Imazu et al. | 72/45 |
| 3,998,174 | 12/1976 | Saunders | 113/120 |
| 4,040,282 | 8/1977 | Saunders | 72/41 |
| 4,043,169 | 8/1977 | Gorgius et al. | 72/349 |
| 4,147,271 | 4/1979 | Yamaguchi | 220/70 |
| 4,148,208 | 4/1979 | Maedor | 72/347 |
| 4,179,909 | 12/1979 | Maeder | 72/45 |
| 4,223,544 | 9/1980 | Main | 72/349 |
| 4,289,014 | 9/1981 | Maeder et al. | 72/348 |
| 4,326,401 | 4/1982 | Inoue | 72/350 |
| 4,372,143 | 2/1983 | Elert et al. | 72/343 |
| 4,620,434 | 11/1986 | Pulciano | 72/347 |
| 4,685,322 | 8/1987 | Clowes | 72/349 |

FOREIGN PATENT DOCUMENTS 61756 10/1948 Netherlands .

*Primary Examiner*—Robert L. Spruill
*Assistant Examiner*—Donald R. Studebaker
*Attorney, Agent, or Firm*—Reese Taylor

[57] ABSTRACT

A method of forming a deep-drawn and ironed container having a bottom profile wherein a cup is formed by drawing an inverted cup and reverse drawing the cup and simultaneously imparting a bottom profile thereto while controlling the thickness of the material in the bottom. The method also includes providing support to the profiled bottom while ironing the cup thus formed. The method is accomplished by a system which includes a draw-redraw station wherein the inverted cup is adjustably held by a fluidly actuated lift out ring and draw pad in the bottom area against a punch during reverse drawing to control metal thickness in the bottom. A separate pressure sleeve is also engaged with the profiled bottom during ironing to prevent pulling material from the bottom.

8 Claims, 10 Drawing Figures

METHOD OF FORMING A DEEP-DRAWN AND IRONED CONTAINER

BACKGROUND OF THE INVENTION

This invention relates in general to a method and apparatus for forming a deep-drawn and ironed container and relates in particular to a method and apparatus for forming such a container having a profiled bottom.

DESCRIPTION OF THE PRIOR ART

The general trend in the container or can making industry is to continually strive to reduce the starting gauge of the material used for the containers. Due to the substantial volumes involved, even minor gauge reductions result in significant cost savings. However, a problem which is commonly encountered as the gauge drops is a loss of strength in the bottom of the container. This problem is particularly serious where the contents of the can are to be packed under pressure.

The common approach to strengthening the bottom of the thinner containers is to impart a profile of some sort, such as a dome or a flat bottom with an annular wall, either of which configurations is intended to impart buckle strength to the bottom. This solution, however, gives rise to yet another problem.

Typically, these two-piece containers are formed by a draw and redraw operation to form a cup and an ironing operation to finish the container. Heretofore, it has been considered not possible to impart the bottom profile prior to the ironing step since during ironing, as the container is elongated, a profile with which might previously have been imparted to the bottom is often simply pulled out. If the profile is not entirely pulled out, at least some of the material is pulled from the bottom, thereby thinning it and, again, weakening it thereby to some extent negating the strengthening value of the profile.

A proposed solution in the industry has been to provide yet a further separate machine in addition to the draw-redraw and ironing apparatus so that the bottom profile can be imparted after the ironing stage. Here again, another difficulty is encountered, because this approach requires completely forming the bottom profile at one time which requires pulling considerable amounts of material from the sidewalls into the bottom.

Examples of cuppers of the type generally referred to above can be seen in Gorgius U.S. Pat. No. 4,043,169. Ironers of the type generally referred to herein can be seen in Maeder U.S. Pat. No. 3,402,591; Imazu U.S. Pat. No. 3,945,231; and Saunders U.S. Pat. No. 4,040,282.

Domers of the type generally referred to herein can be seen, for example, in Maeder U.S. Pat. Nos. 4,179,909 and 4,289,014 and Elert U.S. Pat. No. 4,372,143.

Examples of the general type of container involved herein can also be seen in Saunders U.S. Pat. No. 3,998,174 and Yamaguchi U.S. Pat. No. 4,147,271.

While these patents are presumably effective for the purposes for which they are intended, none of them really comes to grips with and solves all of the problems caused by down gauging as related above.

SUMMARY OF THE INVENTION

It, accordingly, becomes the principal object of this invention to provide a method and apparatus for forming a deep-drawn and ironed container having a suitable bottom profile.

It is a further more specific object of this invention to provide such a container from relatively thin gauge material wherein the material is blanked, drawn and redrawn into a cup having a profiled bottom in a single operation while providing excess material in the bottom area.

It is a further object of the invention to provide for ironing the cup thus formed without destroying or adversely effecting the bottom profile. In furtherance of this object of the invention, it has been discovered that this operation can be performed by providing support for the bottom profile during the ironing operation to prevent damage to or impairment of the previously formed profile.

Optionally, it is a further object of this invention to provide means for resetting or reforming the bottom profile into its final configuration prior to the ironing operation.

Accordingly, production of an improved method and apparatus of forming a deep-drawn and ironed container having a bottom profile becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
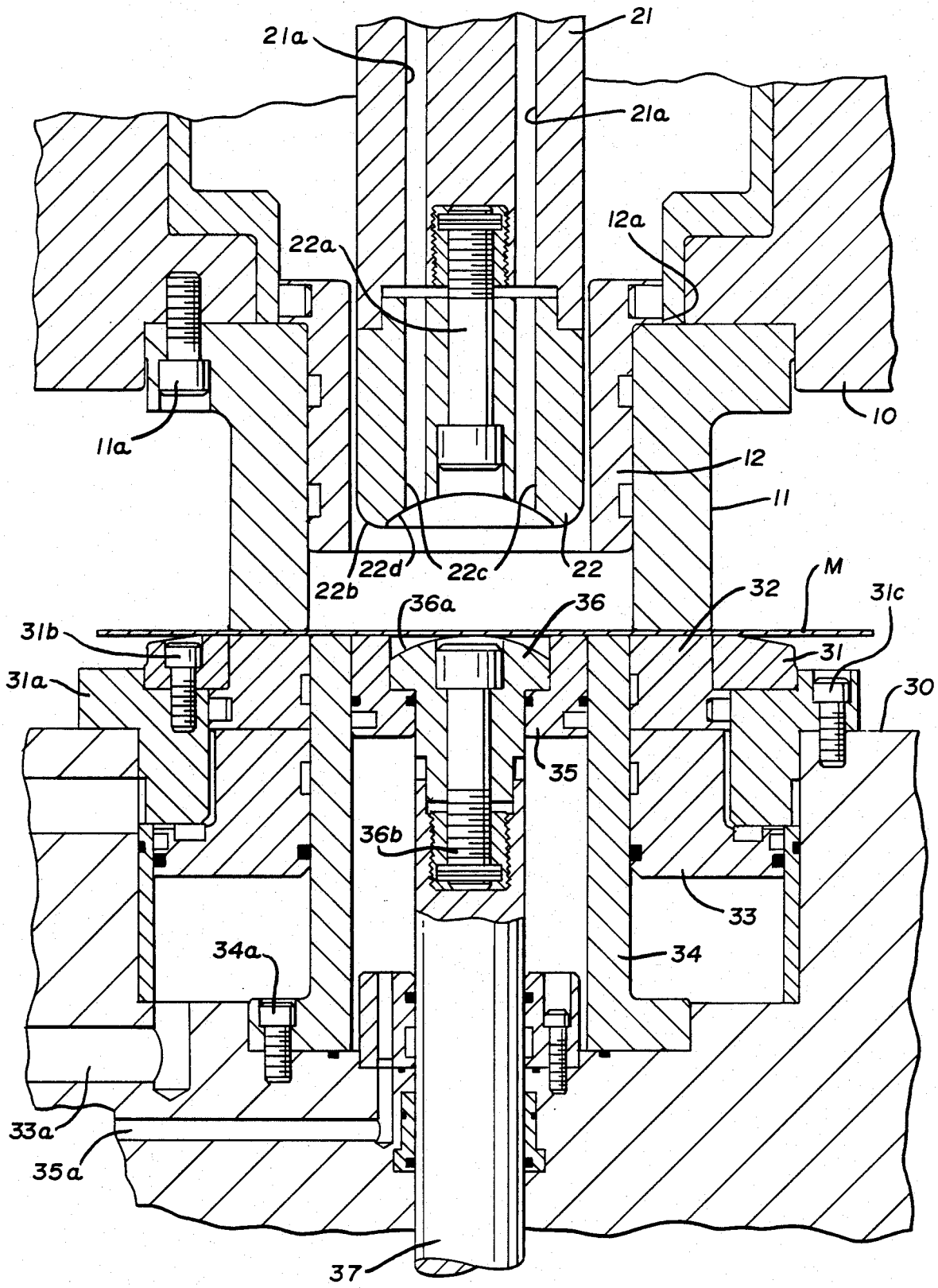
FIG. 1 is an elevational view, partially in section, showing the tooling at the beginning of the blanking and drawing operation.

Referring first then to FIG. 1 of the drawings, it will be assumed that the tooling illustrated therein is incorporated into a double acting press of the type well-known in this art. It will also be assumed that the material M will be fed into the press either from sheet or coil stock, as desired.

With those assumptions in mind and still referring to FIG. 1, it will be noted that the outer slide holder 10 of the press carries a punch sheel 11 which is secured thereto for movement therewith by one or more screws 11a. Radially inboard of the punch shell 11 is a first pressure sleeve 12 which is under fluid pressure, either air or hydraulic, and is reciprocal in a chamber formed by the slide 10 and punch core riser 21.

The inner slide of the press carries the just mentioned punch core riser 21 and a punch core 22 adjustably secured thereto by screw 22*a*. The punch core 22 has a concave recess 22*d* in its projecting end and also terminates in an annular, rounded nose 22*b* with both features assisting in forming the cup, as will be described below. It will also be seen that riser 21 and punch core 22 have coaxial air supply passages 21*a*,21*a*,22*c*,22*c* to assist in removal of the formed cup from punch core 22.

The press base 30 includes a cut edge 31 secured to a retainer 31*a* by one or more screws 31*b* with retainer 31*a*, in turn, being secured to the base by screws 31*c*.

Concentrically disposed radially inboard of the cut edge 31 is a pressure pad 32 supported by a fluidly actuated piston 33 which is supplied with fluid pressure through passage 33*a*.

Still further radially inboard of pressure pad 32 is a fixed die core ring 34 mounted on the base 30 by one or more screws 34*a*.

Inboard of the die core ring 34 is a lift out ring 35, fluidly actuated by suitable fluid pressure through passage 35*a*.

Finally, inboard of the lift out ring 35 is a die core 36 which has a domed or convex top 36*a* and which is adjustably secured to a die core riser 37 by a suitable screw 36*b* with it being understood that the riser 37 can be actuated, either hydraulically or by means of a cam arrangement, so that, in any event, the die core 36 is movable toward and away from the punch core 22.

At this point, it should be noted that die core 36 is illustrated as having a configuration such that it will impart a domed configuration to the bottom of the container for increased strength. It should be understood, however, that a different strengthening configuration could be utilized such as, a tightly wrapped annular wall. The basic object in any event is to increase the material in the bottom area to be used for further forming.

Turning next to the operation of the tooling and still referring to FIG. 1 of the drawings, it will be noted that the movable platen of the press has advanced toward the fixed base 30 to an extent that the outer slide holder 10 and the punch shell 11 carried thereby has advanced into contact with a portion of the material M, clamping it against the pressure sleeve 32 which is at the elevated position, as can clearly be seen in FIG. 1 of the drawings. In other words, the material M, in either sheet or coil form, is in place in the die and engaged by the punch shell 11 and the pressure sleeve 32 and ready for blanking.

Figure 2:
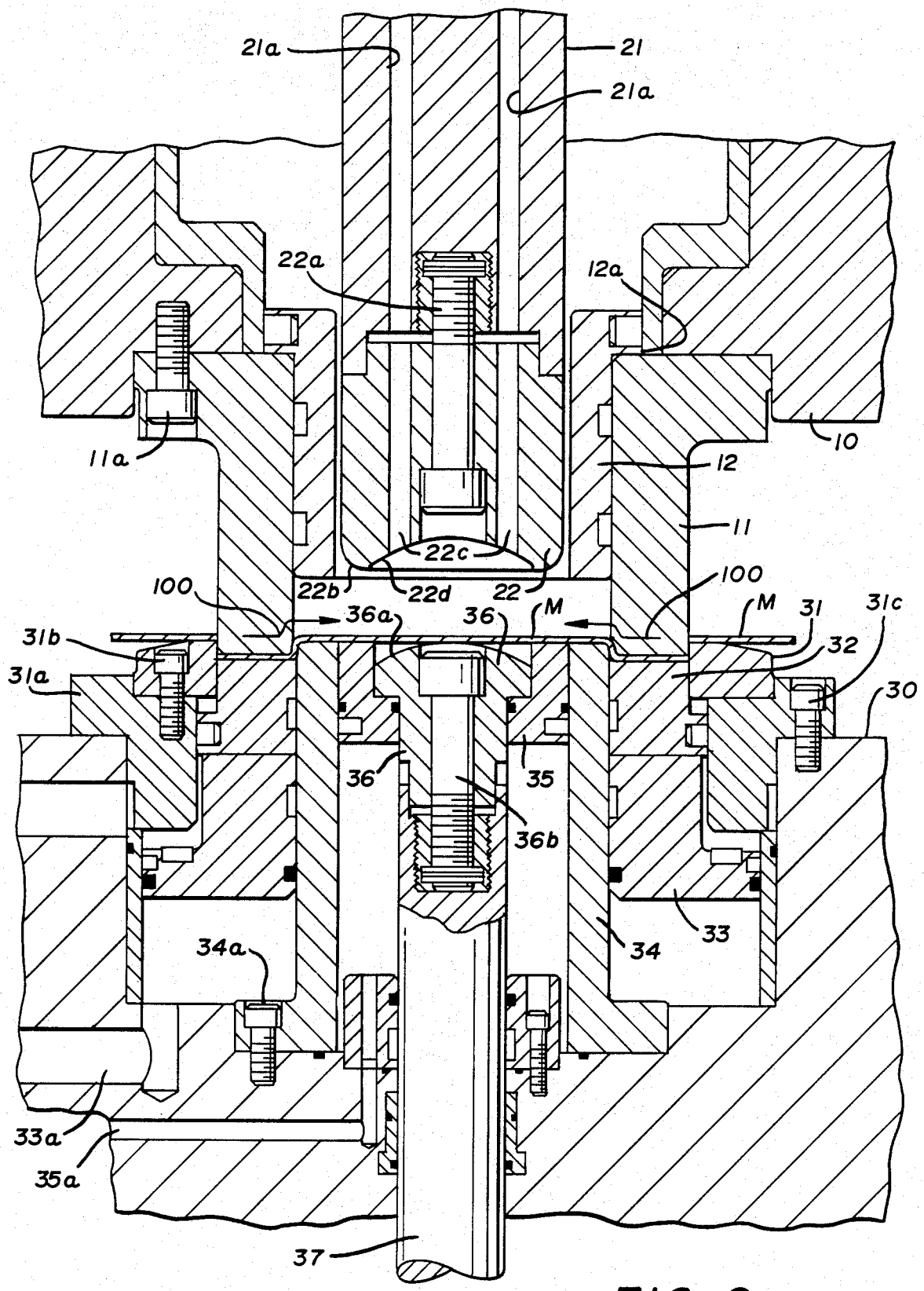
FIG. 2 is a view similar to FIG. 1, showing the position of the tooling after the blanking step.

Further movement of the movable platen of the press toward the fixed base will advance the punch shell 11 so as to blank the material M against the cut edge 31, as can be seen from FIG. 2 of the drawings. The movement of the punch shell 11, at this stage, has begun to overcome the pressure on the piston 33 which, in turn, supports the pressure sleeve 32.

The beginning of the formation of the inverted cup can be seen in FIG. 2 where the periphery of the blank is drawn over the top of the die core ring 34 while die core 36 and knockout piston 35 support the central area of the blank. As will be seen, the material is pulled from the edge areas of the blank and flows in the direction of arrows 100.

Figure 3:
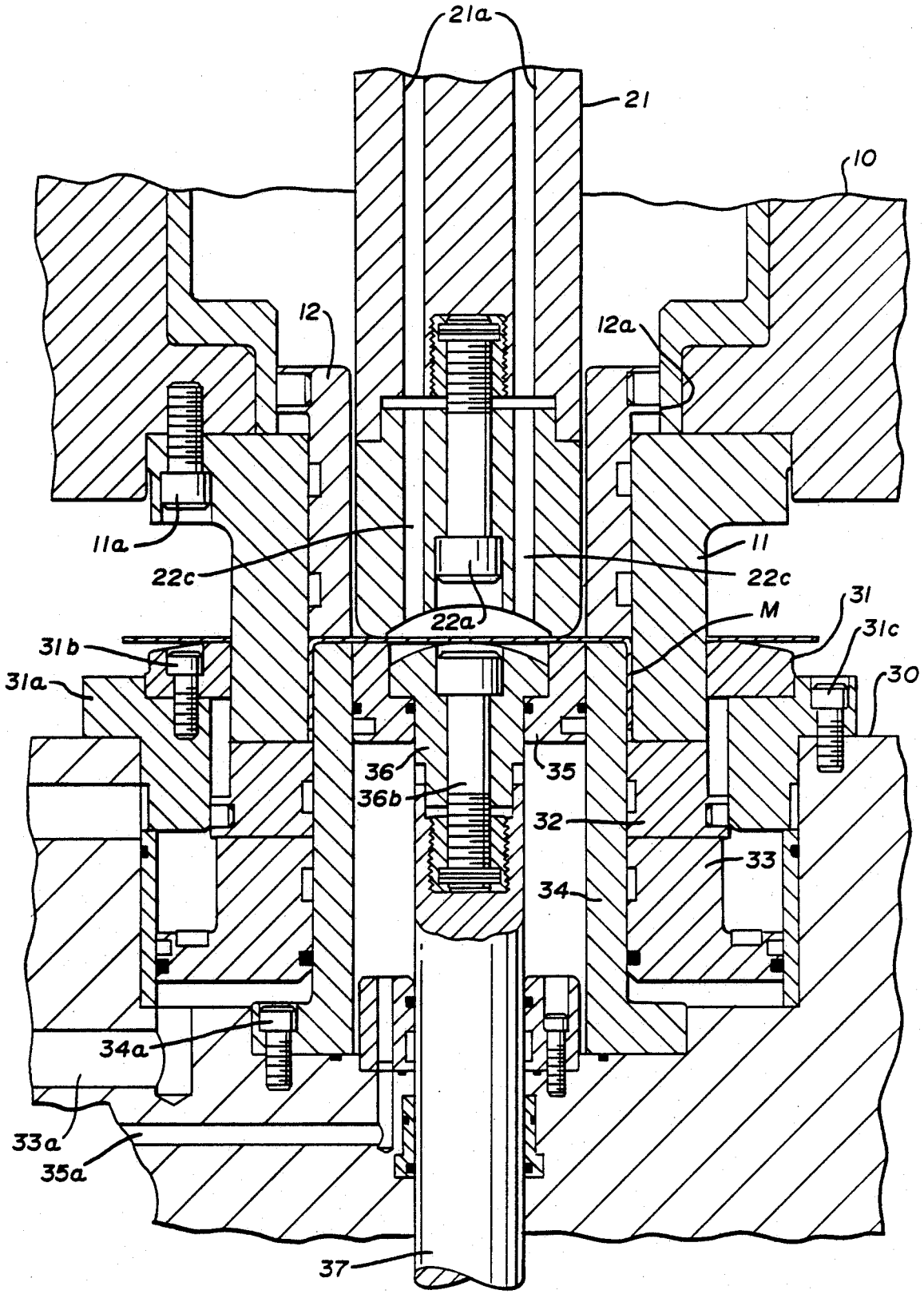
FIG. 3 is a view similar to FIG. 1, showing the position of the tooling after forming of the inverted cup.

Further advance of the movable platen toward the fixed base moves the punch shell 11 still further in the downward direction, and the peripheral edge of the blank will have been wiped over the top of the die core ring 34 to form, essentially, an upside down or inverted cup. As can be seen by comparing FIGS. 2 and 3, the material will have been drawn out of the clamp between punch shell 11 and pressure sleeve 32 during this transition. It will also be noted, at this point, that the upper pressure sleeve 12 has advanced so as to hold the material M against the top of the die core ring 34 and die core 36 and knockout piston 35 continue to support the central portion of the blank.

Figure 4:
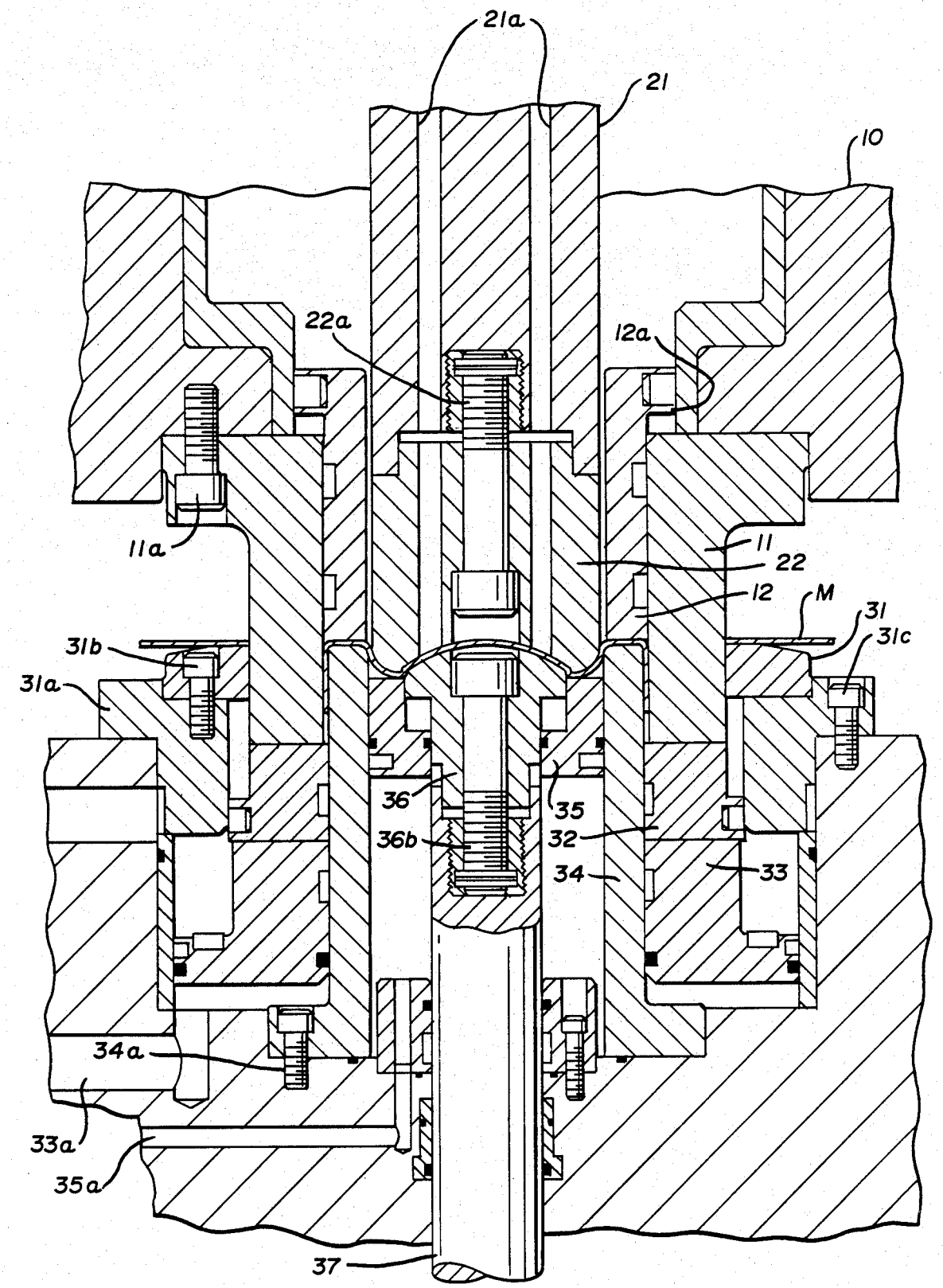
FIG. 4 is a view similar to FIG. 1, showing the position of the tooling at the initiation of the reverse drawing step.

Further advance of the movable platen, as seen in FIG. 4, will advance the punch core 22 against the center portion of the blank, overcoming the pressure on the lift out ring 35 and initiating reverse drawing or inversion of the previously formed cup. At this point, it will be noted that the upper pressure sleeve 12 will still be in contact with the material and that the material will be slidingly clamped between the lower end of the sleeve 12 and the upper end of the die core ring 34.

During this operation, knockout piston 35 is acting as a draw pad or pressure sleeve and controls the flow of the material. The degree of control exerted depends upon the pressure exerted on piston 35 through passage 35*a* and can be varied.

Furthermore, the punch shell 11 will be in contact with the material which is disposed in a gap between its inner peripheral surface and the outer peripheral surface of the die core ring 34 to insure control of the metal as the cup is formed. It will be understood that that gap can be varied by machining of the tooling so that the thickness of the finished cup relative to the starting gauge of the material can be increased or decreased, as desired. Thus, the material can be thinned or thickened.

Additionally, it will be noted that, as previously pointed out, the punch core 22 has a concave recessed area 22*d* formed in its projecting end and also has an arcuate annular nose 22*b*. This nose will begin to form the countersink portion CS of the dome against the top of the die core 36 which has a complemental convex shape. The metal will thus be pulled from the peripheral edge of the blank into the center panel, thereby thickening or thinning it somewhat relative to the starting gauge of the material and forming the domed bottom. Whether the material is thickened or thinned depends, as noted, on the pressure below the punch core 22 with low pressure permitting thickening and high pressure causing thinning in the countersink area.

Figure 5:
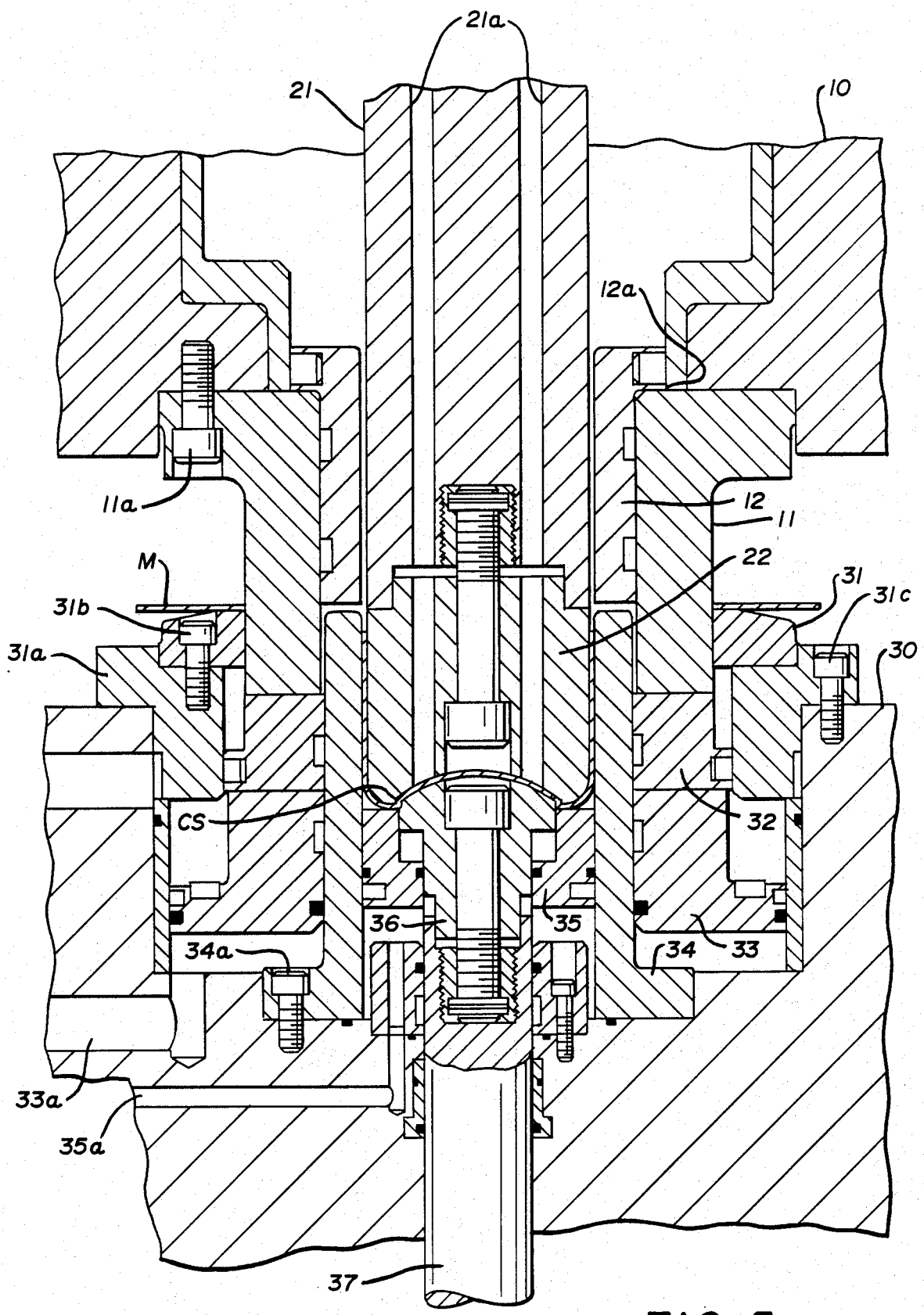
FIG. 5 is a view similar to FIG. 1, showing the position of the tooling at the completion of the reverse drawing step.

FIG. 5 illustrates the finish of the draw-redraw operation wherein the material has been pulled completely out of its engaging contact between the outer peripheral surface of the die core ring 34 and the inner peripheral surface of the punch shell 11 and from between the lower end of the pressure sleeve 12 and the upper end of the die core ring 34 and the bottom completely formed. The pressure sleeve 12 will also be seen to have been stopped off by engagement of its shoulder 12*a* with the top of punch shell 11 to avoid applying too much holding pressure thus avoiding pinching of the material as the last of the material is pulled out of the clamp between punch shell 11 and die core ring 34. The continuing downward movement of the movable platen of the press will have advanced the punch core 22 still further downward into the cavity of the fixed base 30 during this step, overcoming the supporting pressure on the die core 36 and the die core riser 37 in the event that member is fluidly supported or, alternatively, if that member is supported by a cam, the cam will be off the cam rise and will permit this downward movement. In either event, the domed bottom portion is clearly formed in FIG. 5 of the drawings.

Figure 6:
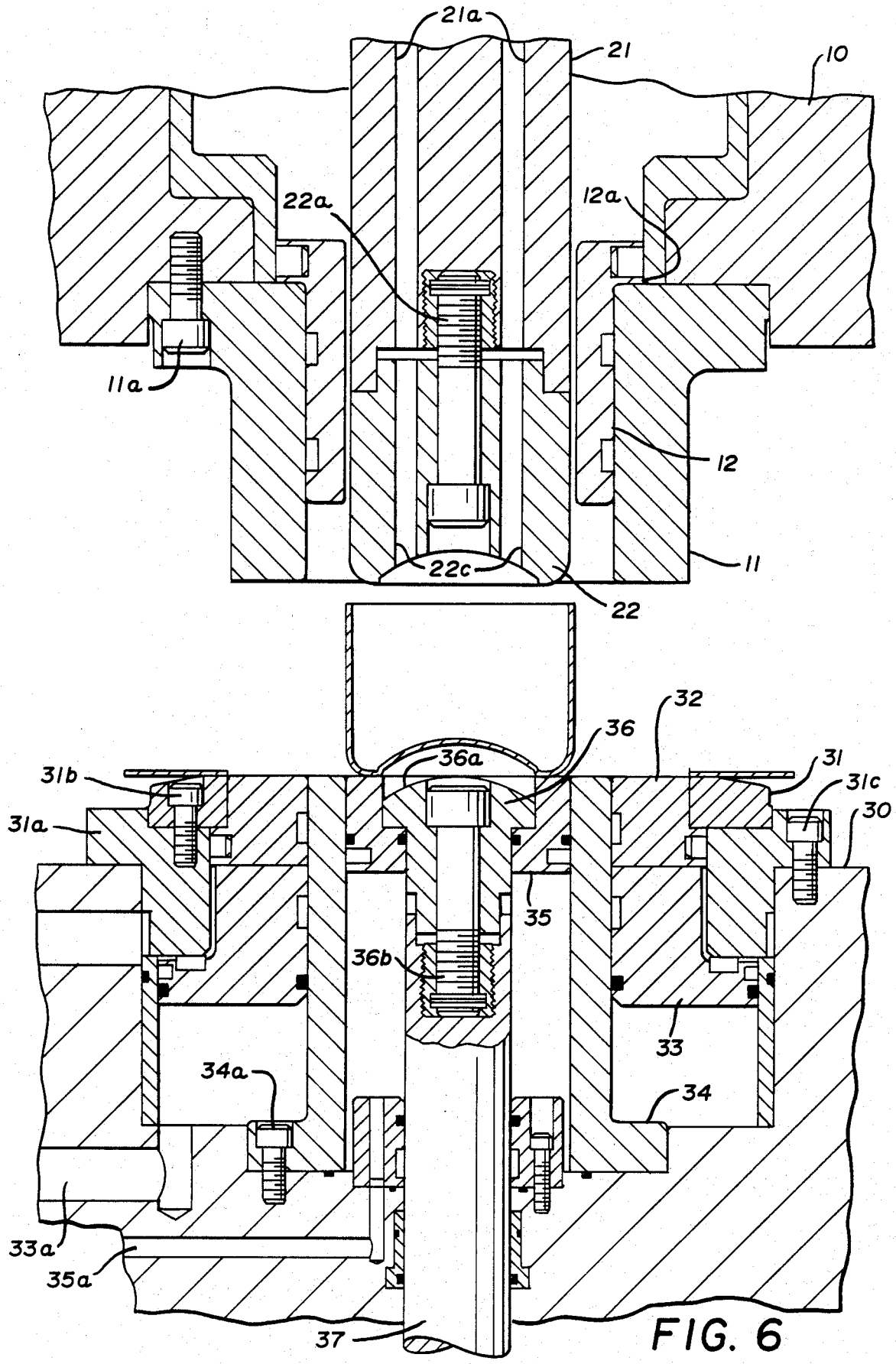
FIG. 6 is an elevational view of the tooling with the formed cup returned to the die line for removal from the press.

FIG. 6 simply illustrates the tooling after the movable platen has retracted and the supporting force on the lift out ring 35 and on the die core 36 have been permitted to elevate the cup to the die line whereupon it can be removed from punch core 22 by air applied through passages 21*a*,21*a* and 22*c*,22*c* and passed to the body maker.

At this point, it should be noted that, if desired, the cup could be removed below the die line. Such an expedient can be accomplished by extending the stroke of punch core 22, permitting greater retraction of the die core 36 and providing an open space below base 30.

In either case, the cup C is now ready to be transferred to the body maker for further forming.

Figure 7:
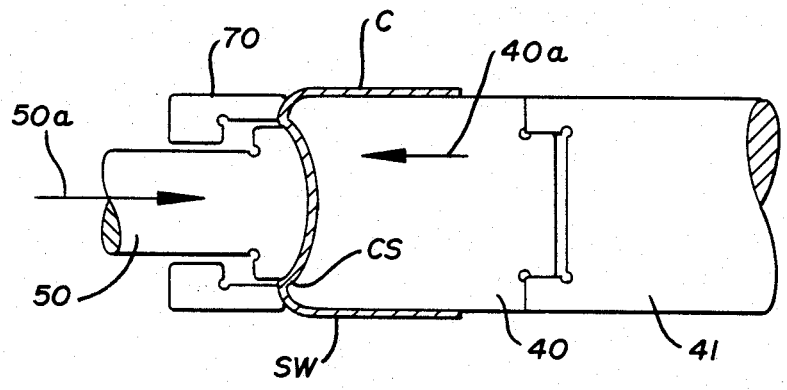
FIG. 7 is a partially schematic view, showing the domed cup in place on the doming punch prior to ironing.
Figure 8:
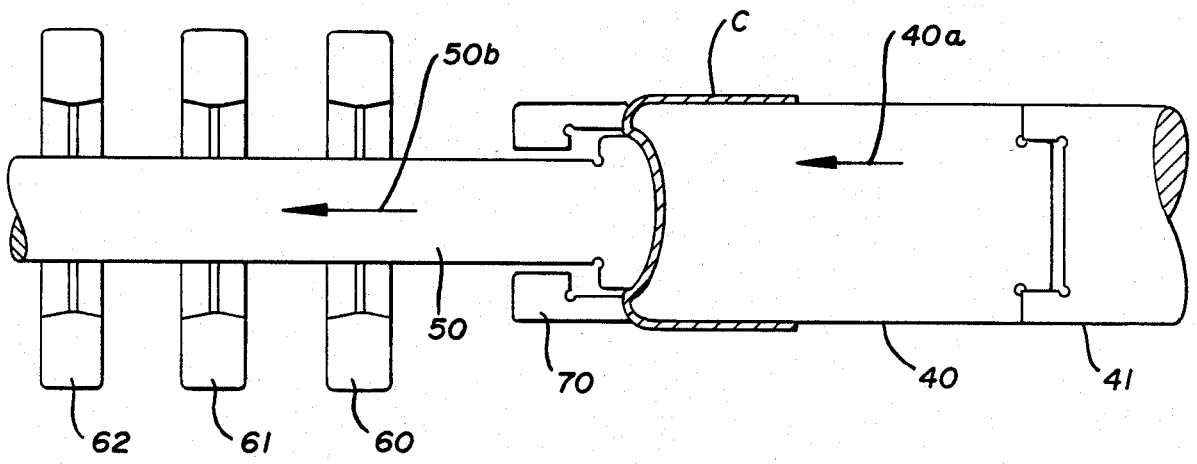
FIG. 8 is a further schematic view similar to FIG. 7, illustrating the ironing rings.

FIG. 7 of the drawings illustrates the domed cup C in place on the punch 40 at the body maker. The tooling here has been illustrated schematically only. Thus, a punch riser 41 is secured to means for advancement in the direction of arrow 40*a* or toward the fixed ironing rings (FIG. 8) which are also schematically illustrated. At this point, the doming post 50 will be advanced in the direction of arrow 50*a* into contact with the domed bottom portion of the cup. Additionally, the fluidly supported pressure sleeve 70 will engage the bottom profiled area of the cup.

Assuming, for example, a domed bottom as illustrated in the drawings, the countersink area CS can be reset or tightened up at this point as doming post 50 is advanced toward redraw punch 40. By control of the stroke of either or both members, the countersink area can either be "reset" or merely maintained, as desired.

Figure 9:
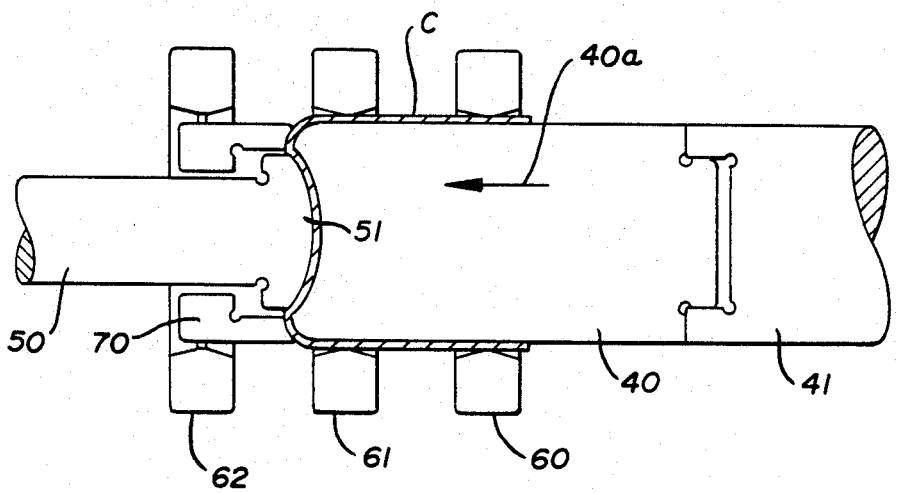
FIG. 9 is a schematic, elevational view, showing the position of the tooling during the ironing operation.
Figure 10:
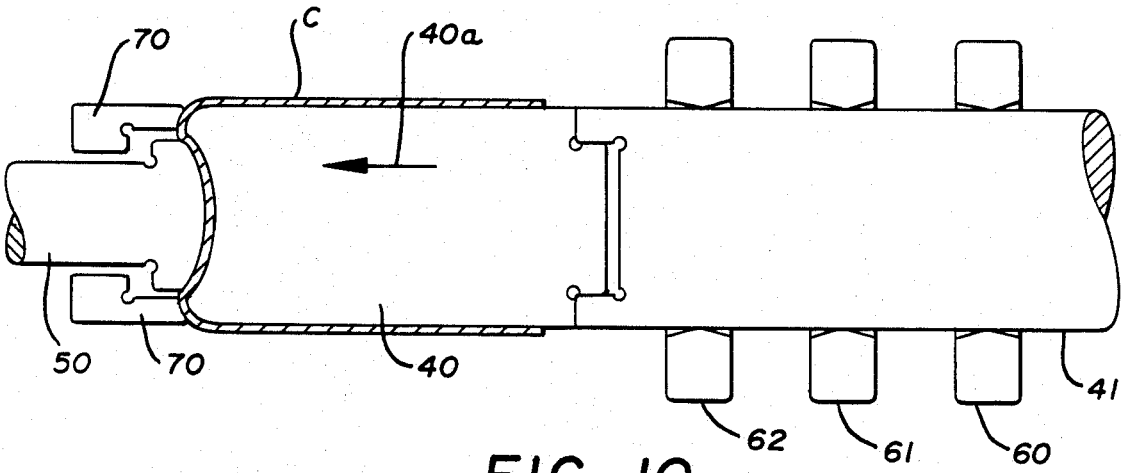
FIG. 10 is a schematic, elevational view, showing the position of the tooling following ironing.

In FIG. 7, the tooling is then positioned to be passed through the ironing rings 60, 61, and 62 which present progressively smaller internal diameters so as to iron the side walls SW of the cup C and elongate the cup to its final desired dimension. This is accomplished by further advance of redraw punch 40 in the direction of arrow 40*a* with doming post 50 receeding in the direction of arrow 50*b*, as can be seen in FIGS. 9 and 10. It will be noted, however, that, by means of the support produced by the doming post 50 and the pressure sleeve 70, that the normal thinning often encountered in the domed or profiled bottom area during the ironing operation will be prevented, since positive support will be presented in this area. Also, as previously noted, this eliminates the problem of pulling the dome or bottom profile out of the bottom during the ironing operation.

Once the assembled tooling has passed through the ironing rings 60, 61 and 62, it can be removed from the ironing punch 40 in conventional fashion.

While a full and complete description of the invention has been set forth in accordance with the dictates of the Patent Statutes, it should be understood that modifications can be resorted to without departing from the spirit hereof or the scope of the appended claims.

Thus, if the bottom configuration is appropriate, such as where the portion thereof from the sidewall SW to the chuckwall CW is concave, the sleeve 70 alone would provide sufficient support.

It will also be understood that only the tooling necessary to form one container has been illustrated, although it is common practice to provide multiple tool sets so that more than one can can be produced in each operational cycle.

What is claimed is:

1. A method of forming a deep drawn and ironed container having a profiled bottom, comprising the steps of:
   (a) blanking a generally circular blank;
   (b) wiping the peripheral edge of the blank about a die core ring to form an inverted cup;
   (c) reverse drawing the inverted cup and forming a profiled bottom by advancing a punch having a contoured central portion against a movable die core having a complementally contoured central portion;
   (d) removing the profiled cup to a body maker;
   (e) engaging the profiled cup between an ironing punch and a profiling post; and
   (f) passing said cup through one or more ironing rings while supporting the profiled area thereof.

2. The method of claim 1 wherein excess material is provided in the bottom of the cup during the reverse drawing step by decreasing pressure opposite the punch.

3. The method of claim 1 wherein the profile of the cup is reset by said profile post.

4. The method of claim 1 wherein the entire bottom area of the cup is supported during passage through the ironing rings.

5. The method of claim 1 wherein the profiled area of the cup is supported during passage through the ironing rings.

6. A system for forming a deep-drawn and ironed container having a bottom profile from a blank of material, comprising:
   (A) a draw-redraw station including
      (1) a movable platen carrying
         (a) a punch shell;
         (b) a profiled punch core; and
         (c) a first, fluidly actuated pressure sleeve; and
      (2) a fixed base carrying
         (a) a pressure pad;
         (b) a die core ring;
         (c) a lift out ring and draw pad; and
         (d) a profiled die core; and
      (3) said punch shell being movable toward said die core ring to wipe the blank over said die core ring to form an inverted cup;
      (4) said punch core being movable toward said die core to reverse draw the inverted cup and profile the bottom thereof in cooperation with said die core; and
      (5) said lift out ring and draw pad engaging the material against said punch core during the reverse draw to control metal thickness; and
   (B) an ironing station including
      (1) a punch engagable with the interior of the cup;
      (2) a post reciprocally disposed with respect to said punch and engagable with the exterior of the bottom of the cup;
      (3) a pressure sleeve engagable with at least a portion of the exterior of the bottom of the cup;
      (4) at least one ironing ring; and
      (5) said punch, said post and said pressure sleeve being movable through said ironing ring.

7. The system of claim 6 wherein said punch shell has an internal diameter greater than the external diameter of said die core ring whereby a gap is formed therebetween; the material of the inverted cup being slidingly engaged in said gap during reverse drawing of the cup.

8. The system of claim 6 wherein said first pressure sleeve has a radially outwardly disposed shoulder; and said punch shell has a top surface for engagement with said shoulder of said first pressure sleeve after a predetermined amount of travel whereby clamping pressure imparted by said first pressure sleeve during reverse drawing is limited.

* * * * *